US005979374A

United States Patent [19]

Jackson

[11] Patent Number: 5,979,374

[45] Date of Patent: Nov. 9, 1999

[54] CONTROL COOLED CYLINDER LINER

[75] Inventor: Peter E. Jackson, Columbus, Ind.

[73] Assignee: Cummins Engine Company, Inc., Columbus, Ind.

[21] Appl. No.: 09/096,511

[22] Filed: Jun. 12, 1998

[51] Int. Cl.[6] ..... F02F 1/10; F02F 1/16

[52] U.S. Cl. ..... 123/41.84; 123/193.2

[58] Field of Search ..... 123/41.83, 41.84, 123/193.2

[56] References Cited

U.S. PATENT DOCUMENTS

| | | | |
|---|---|---|---|
| 3,800,751 | 4/1974 | Glassey et al. . | |
| 4,187,767 | 2/1980 | Jones, Jr. et al. | 92/171 |
| 4,244,330 | 1/1981 | Baugh et al. . | |
| 4,284,037 | 8/1981 | Kasting et al. . | |
| 4,294,203 | 10/1981 | Jones | 123/195 R |
| 4,926,801 | 5/1990 | Eisenberg et al. . | |
| 5,176,113 | 1/1993 | Hama et al. . | |
| 5,189,992 | 3/1993 | Hama et al. . | |
| 5,199,390 | 4/1993 | Hama et al. . | |
| 5,207,188 | 5/1993 | Hama et al. . | |
| 5,207,189 | 5/1993 | Kawauchi et al. . | |
| 5,211,137 | 5/1993 | Kawauchi et al. . | |
| 5,233,947 | 8/1993 | Abe et al. . | |
| 5,251,578 | 10/1993 | Kawauchi et al. . | |
| 5,251,579 | 10/1993 | Morris | 123/41.84 |
| 5,386,805 | 2/1995 | Abe et al. . | |
| 5,402,754 | 4/1995 | Gunnarson | 123/41.84 |

FOREIGN PATENT DOCUMENTS

| | | |
|---|---|---|
| 0356227 | 2/1990 | European Pat. Off. . |
| 1043913 | 11/1953 | France . |
| 1231337 | 9/1960 | France . |
| 2337444 | 2/1975 | Germany . |
| 58-138245 | 8/1983 | Japan . |

*Primary Examiner*—Willis R. Wolfe
*Assistant Examiner*—Brian Hairston
*Attorney, Agent, or Firm*—Sixbey, Friedmna, Leedom & Ferguson; Charles M. Leedom, Jr.; Donald R. Studebaker

[57] ABSTRACT

A replaceable cylinder liner for an internal combustion engine having a liner stop positioned within a cylinder cavity at a point intermediate the extremes of travel of a piston disposed for reciprocating travel within the cylinder cavity. The liner includes a hollow cylinder body having an inner end portion and an outer end portion. The liner further includes a liner support for axially supporting the hollow cylindrical body within the cylinder cavity with the liner support including a liner stop engaging surface for engaging the liner stop when the liner is placed within the cylinder cavity. Formed in an outside surface of the outer end portion between the end boss and liner support is an annular recess extending over substantially an entire length of the outer end portion to form a liner coolant passage when the liner is positioned in the cylinder cavity. Additionally, provided within the recess is a plurality of thickened regions or lands circumferentially spaced about an outside surface of the outer end portion. Each of the lands frictionally engages the inside surface of the cylinder cavity in that the lands include an effective outside diameter which slightly greater than an inside diameter of corresponding portions of the cylinder cavity into which the plurality of the thickened regions are press fitted.

23 Claims, 3 Drawing Sheets

CONTROL COOLED CYLINDER LINER

TECHNICAL FIELD OF THE INVENTION

The present invention relates to replaceable cylinder liners for internal combustion engines. Particularly, the present invention relates to a controlled cooled cylinder liner for increasing the bore diameter without increasing the distance between cylinders.

BACKGROUND OF THE INVENTION

Incorporation of replaceable cylinder liners in the design of an internal combustion engine provides numerous advantages to the manufacture and user of such an engine. In addition to the obvious benefit of allowing such liners to be replaced during overhaul of the engine without replacement of the entire cylinder block, cylinder liners eliminate the necessity to scrap the entire block during manufacture should the inside surface of one cylinder being improperly machined. Despite this and other advantages, numerous problems attend the use of replaceable cylinder liners as is exemplified by the great variety of liner designs previously used by engine manufacturers. While each of the previously known liner designs exhibit their own distinct advantages, no single design appears to provide a liner design wherein an increase in bore diameter is achieved without the need to increase the distance between the cylinder centers, thus allowing increased sweep volume from an existing engine.

Additionally, there is a trend in the industry to increase the output of internal combustion engines by increasing the firing pressures and thermal load of the engines. This trend has tended to favor the adoption of wet type liners in a cylinder block where the liner is in direct contact with a cooling medium over an extended portion of its length thereby providing improved heat transfer and allowing the operation of engines at higher firing pressures and increased thermal loading.

However, conventional wet type cylinder liners have several disadvantages. Since the wet liner requires substantial space for the cooling liquid, the use of such liners substantially increases the distance between the a center lines of the several cylinders, this increase being necessary to ensure space for cylinder block and liner walls of adequate thickness to withstand the increased mechanical and thermal loads and to resist cavitation erosion. Also, this increase is necessary in order to provide room for a flange to support the wet type liner in the cylinder block. The greater distance between the cylinder bores, of course, increases the overall length of the engine, and thereby adds cost, weight and bulkiness to the engine.

Wet liners also require the installation of seals between the lower portion of the liner and the cylinder block to prevent the cooling medium from migrating into the oil and vis versa. These seals are susceptible to damage and adversely effect engine reliability and durability, and increase maintenance costs. On the other hand, a fully dry liner where the liner is separated from the cooling medium throughout its entire length also has several disadvantages. The heat transfer between the liner and the cooling medium is restricted because the coolant flow is disrupted by cast cylinder head screw bosses located around the upper portion of the liner. Also, it is difficult and expensive to cast clean cooling passages around the liner supporting the structure of the cylinder block. Finally, the dry type liner has a lesser capacity for heat dissipation from the liner than the fully wet liner and thus does not readily accommodate the trend toward increased firing pressures and thermal loading presently encountered in internal combustion engines.

Presently, both wet and dry type cylinder liners incorporate either a mid-stop arrangement wherein the cylinder liner is substantially supported within the block mid-way along the length of the cylinder liner or a top stop wherein the cylinder liner is supported about an upper periphery thereof. U.S. Pat. No. 3,403,661 discloses a liner design for use in an engine block having a counter bore cylinder cavity wherein the liner includes a radially outwardly extending flange designed to be seated in the counter bore so that the liner may be easily clamped into place by the engine cylinder head. In order to provide for coolant flow around the liner, a seal is provided between the engine block and a lower portion of the liner spaced from the top flange. Due to vibration and thermally induced size changes of the liner, relative motion occurs in the seal area of a type which may destroy conventionally known seals. This is particularly true since coolant passages are normally formed in a manner to cause particles within the coolant to collect in the seal area and eventually work between the seal surfaces resulting in hastened seal destruction.

One possibility for solving the coolant seal problem would be to move the block engaging flange of the liner to the lowermost point in the coolant passage such as is illustrated in U.S. Pat. No. 3,315,573 issued to Castelet. This approach, however, leads to head gasket seal problems due to the unequal thermal expansion of the block and the liner. While such top seal leaks may be solved in part by the provision of a composite liner having a thermal expansion coefficient more nearly equal to that of the engine block, the provision of such a composite structure measurably increases the manufacturing costs and is thus not an optimum design.

Some manufacturers have resorted to complicated compliant or even resilient seals to accommodate size changes due to thermal expansion such as that illustrated in U.S. Pat. Nos. 3,628,427 and 3,882,842. The liner designs illustrated in these patents present additional problems by the virtue of the provision of an upper liner portion which is out of direct radial contact with the engine block. This arrangement increases the possibility of undesirable relative movement between the liner and engine head which can result in head gasket failure or in the need for liner wall thickening which adds to the cost and decreases thermal conduction through the liner.

One approach for solving the above-noted problems is set forth in U.S. Pat. No. 4,244,330 issued to Baugh et al. and assigned to the assignee of the subject invention. Therein, the cylinder liner for an internal combustion engine includes a cylindrical hollow body having a press-fitted upper end and a stop located intermediate the liner ends for engaging an engine block liner stop to provide upper and lower seals for a coolant passage. The outside surfaces of the liner adjacent the press-fitted upper end and the stop are formed to permit a setable plastic material to be used between the liner and engine block to assist in forming the coolant seal and to provide radial support of the liner to permit the lower 30 percent of the cylinder liner to be free of any direct contact with the engine block. This design also permits use of a smaller capacity cooling system and improves lubricating oil flow within the engine block. In this regard, the only contact between the cylinder liner and engine block is that provided at the middle region of the cylinder liner and the interference fit about an upper periphery of the liner. In this regard, the thickness of the cylinder liner in the region adjacent the water jacket about an upper periphery of the cylinder liner must be of a size which can resist increased firing pressures and thermal loading of engines incorporating such liners. It is a primary object of the present invention to provide a cylinder liner wherein the thickness of the cylinder liner wall in this region can be reduced without sacrificing support of the liner to counteract high firing pressures on the order of 2,000 to 4,000 psi. Moreover, this wall thickness is reduced in a manner such that the bore diameter is increased without the need to increase the distance between cylinder centers thus increasing the sweep volume of existing engines.

U.S. Pat. No. 4,926,801 issued to Eisenberg et al. attempts to overcome a number of the above-noted shortcomings. Therein, a cylinder liner having a midstop arrangement is positioned within a bore and a cylinder block such that the lower two-thirds of the liner contact the cylinder block providing a dry type cylinder liner in this area. The upper portion or upper one-third of the liner is of a wet type and includes a plurality of flow passages for directing the flow of coolant about an outer periphery of the cylinder liner. The flow passages include thickened portions for increasing the strength of the upper portion of the cylinder liner, however, there is no support of the liner by the cylinder block in this area. Accordingly, depending upon the thickness of the cylinder liner in the upper region thereof, the liner may become distorted when subjected to heat generated by firing pressures in the range of 2,000 to 4,000 psi.

With reference to European Pat. Application No. 0 356 227 B1, a cooling system for a multi-cylinder engine is set forth wherein the cylinder liners include a plurality of axially aligned passages for aiding in the cooling of the an upper portion of the cylinder liner. The liner is of the top stop type and all of the aforementioned shortcomings associated with this type of liner continue to be of concern. Therein, the liner includes a plurality of cooling fins mounted at circumferentially spaced locations on the entire outer peripheral surface of the body of the wet liner such that when placed in close contact with the inner peripheral surface of the cylinder wall of the cylinder block, a plurality of rectilinear parallel cooling passages extending in the direction of the cylinder liner axis are obtained. The fins, however, are provided for directing coolant from a lower cooling gallery to a upper cooling gallery and do not provide support for the liner along its length in order to provide for an increase bore diameter without the need to increase the distance between cylinders liners.

Accordingly, there is clearly a need for a controlled cooled liner having a minimal wall thickness and a mid section support between a mid stop seat portion and a top deck portion in order to increase the cylinder bore diameter without increasing the distance between cylinder centers. Particularly, the controlled cooled liner would include a ring of lands positioned between vertical grooves formed in an outer wall portion of the liner which provide an interference fit between the liner and the engine block in the area between upper and lower cooling galleries. The grooves provide for the flow of coolant from a lower water gallery at an entry to the block to an upper water gallery at an exit from the block to prevent any overall cooling losses. In this regard, the thickness of the liner adjacent the coolant galleries can be reduced as compared to a conventional wet liner with the lands providing support to the mid section of the liner to prevent excessive liner deflection and cavitation when subjected to increase firing pressures in the range of 2,000 to 4,000 psi and the thermal loading associated with such pressures.

SUMMARY OF THE INVENTION

A primary object of the present invention is to overcome the aforementioned shortcomings associated with prior art cylinder liners.

A further object of the present invention is to provide a cylinder liner which permits an increase in bore diameter without the need to increase the distance between the cylinder liners.

A still further object of the present invention is to provide a liner of increased bore diameter which allows for an increase in sweep volume in existing engines without the need to increase the distance between cylinder liners.

A still further object of the present invention is to provide a mid stop type wet cylinder liner having support for the mid section of the liner between the mid stop position and the top deck of the liner such that the remaining portion of the liner can be reduced in thickness without impairing structural rigidity of the liner.

A still further object of the present invention is to provide a mid stop type wet cylinder liner wherein support is achieved utilizing a ring of grooves in which the grooves transfer water between lower and upper water jackets with the lands between the grooves providing an interference fit in the cylinder block.

A still further object of the present invention is to provide a mid stop type cylinder liner wherein the mid stop is configured so as to prevent outward sliding of the liner and thus maintain straightness of the liner within the cylinder bore.

A still further object of the present invention is to provide a mid stop type liner wherein excessive bore distortion and high liner fillet stresses are minimized.

These as well as additional objects of the present invention are achieved by providing a replaceable cylinder liner for a cylinder cavity within a cylinder block of an internal combustion engine having a liner stop positioned within the cavity at a point intermediate the extremes of travel of a piston disposed for reciprocating travel within the cylinder cavity. The liner includes a hollow cylinder body having an inner end portion and an outer end portion with the outer end portion having a piston engaging inside surface for guiding the piston during travel and a top end face for forming a combustion gas seal with an engine head. The liner further includes a mechanism for reinforcing and securing the liner in place within the cylinder cavity and for resisting deforming forces resulting from fuel combustion within the outer end portion and for compressively and frictionally engaging an inside surface of the cylinder cavity when pressed therein. The reinforcing and securing mechanism includes an end boss adjacent and outer end of the outer end portion, an outer diameter of such end boss being slightly greater than an inside diameter of corresponding portions of the cylinder cavity into which the end boss is press fitted. The replaceable liner further includes a liner support for axially supporting the hollow cylindrical body within the cylinder cavity with the liner support including a liner stop engaging surface for engaging the liner stop when the liner is placed within the cylinder cavity.

Formed in an outside surface of the outer end portion between the end boss and liner support is an annular recess extending over substantially an entire length of the outer end portion to form a liner coolant passage when the liner is positioned in the cylinder cavity. Additionally, provided within the recess is a plurality of thickened regions or lands circumferentially spaced about an outside surface of the outer end portion. Each of the lands frictionally engages the inside surface of the cylinder cavity in that the lands include an effective outside diameter which is less than an outside diameter of the end boss and slightly greater than an inside diameter of corresponding portions of the cylinder cavity into which the plurality of the thickened regions are press fitted. In doing so, the reinforcing and securing mechanism resists deforming forces resulting from fuel combustion within the outer end portion and compressively and frictionally engages an inside surface of the cylinder cavity when press fitted therein.

These as well as additional objects of the present invention will become apparent from the following detailed description of the invention when read in light of the several figures.

BRIEF DESCRIPTION OF THE DRAWINGS

These as well as additional objects of the present invention will become apparent from the following detailed description of the invention when read in light of the several figures.

DETAILED DESCRIPTION OF THE DRAWINGS

Figure 1:
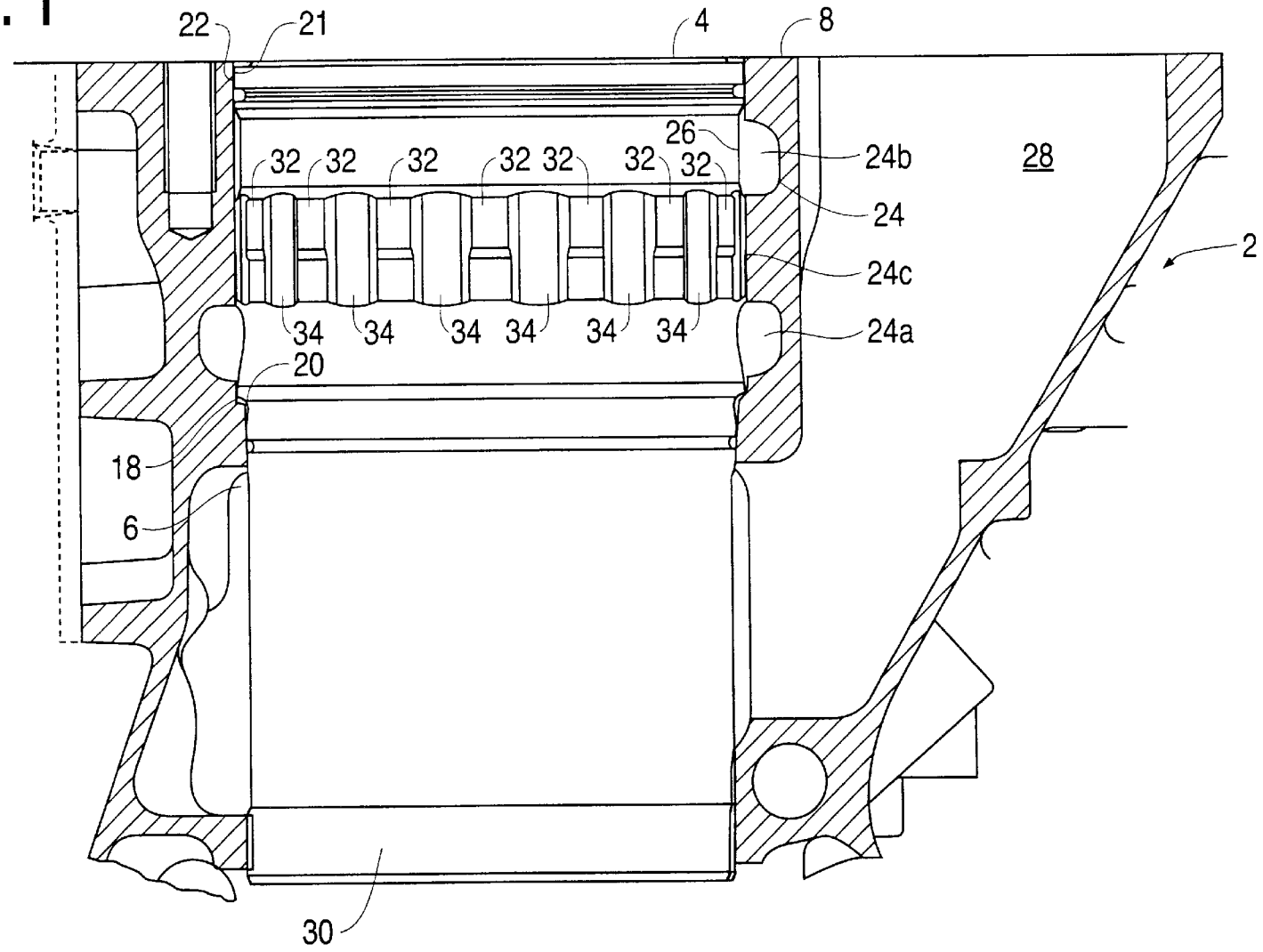
FIG. 1 is a sectional view of an internal combustion engine block including a cylinder liner constructed in accordance with the present invention.

The present invention will now be described in detail hereinbelow with reference to the several figures. Like reference numerals will be utilized throughout the discussion to refer to like elements therein.

The present invention is directed to a cylinder liner of particular design capable of achieving the same functional results which heretofore has required a considerably more complicated structure. Moreover, the disclosed design allows for a reduced thickness in the outer end portion of the cylinder liner which aids in cooling the outer end portion of the liner in view of increased firing pressures and thermal loading presently realized in heavy duty internal combustion engines without sacrificing the structural integrity of the liner.

In particular, with the present invention, the disclosed cylinder liner permits a significant reduction in the thickness of the side wall of the replaceable cylinder liner in the outer end portion thus increasing the heat dissipating capacity of the engine cooling system. Additionally, the present invention adopts a cylinder liner design which permits a significantly simplified and yet improved seal between the liner and engine block and between the liner and engine head.

To understand the manner in which the various improvements noted above are achieved, reference is made to FIG. 1 in which an engine block 2 is illustrated in combination with a cylinder liner 4 structured in accordance with the present invention. Engine block 2 contains a cylinder cavity 6 extending between a surface 8 for engaging the engine head and a crankshaft receiving area (not shown). A piston is connected to the engine crankshaft by a connecting rod, both of which are not illustrated, to cause the piston to travel reciprocally within the liner between an upper limit and lower limit in a conventional manner. The engine block 2 is further provided with a liner stop 18 intermediate the lower limits of the piston travel. A mating stop engagement surface 20 is formed on the exterior of the cylinder liner form at an axial position arranged to cause the outer end of the cylinder liner to protrude slightly beyond the surface 8 of the engine block 2. For purpose of this description, the term "outer" will refer to a direction away from the crankshaft of the engine whereas the term "inner" will refer to a direction towards the engine crankshaft.

The outer end 21 of the cylinder liner 4 is slightly enlarged, for reasons which will be explained in more detail hereinbelow, to provide a press fit with a mating cylindrical surface 22 formed on the interior of the cylinder cavity 6 adjacent the engine head engaging surface 8. Between surface 22 and stop 20 of the engine block, a coolant passage 24 is formed to provide a flow of coolant around the cylinder liner thereby removing heat generated within the cylinder liner due to friction and fuel combustion. The annular recess 26 is formed in the outer surface of the cylinder liner 4 in order to provide one wall of the coolant passage 24.

As can be seen from FIG. 1, the coolant passage 24 includes a lower chamber 24*a* and upper chamber 24*b* as well as a region 24*c* formed between the lower passage 24*a* and upper passage 24*b*, the significance of which will be explained in greater detail hereinbelow.

As is apparent from FIG. 1, the axial length of the coolant passage 24 formed of sections 24*a*, 24*b* and 24*c* extends over approximately 30 percent of the total axial length of the liner. By this arrangement, stop 20 may be moved relatively high in the engine block with respect to the engine head engaging surface 8 thereby providing additional room for return oil flow from the valve train area 28 into the lower portion of the engine block. To achieve this enlarged oil return flow path, the lower portion of the liner 4 is substantially free of all contact with the engine block along at least 30 percent of the innermost axial length of the liner. The liner may include a thickened region 30 formed about an innermost region of the liner which may contact portions of the engine block 2 in order to stabilize the innermost portion of the liner. However, the liner may be free of all contact about the inner end portion of the liner.

In order to more clearly understand how the cylinder liner design of FIG. 1 is capable of optimizing sometime conflicting goals of low cost simplicity and high performance characteristics, reference is made to U.S. Pat. No. 4,244,330, assigned to Cummins Engine Company, the contents of which are incorporated herein by reference.

With reference again to the outer end portion of the liner 4, positioned within the recess 26 are a plurality of lands or thickened regions 32 which extend from an outer surface of the recess 26. Additionally, formed between each of the lands 32 are passages 34 which permit the flow of coolant from the lower coolant passage 24*a* to the upper coolant passage 24*b* in the region of 24*c*. This ring of vertical passages or grooves 34 over the mid section of the water jacket area conduct cooling fluid between the circumferential lower water gallery 24*a* at the entry to the block to the upper water gallery 24*b* at the exit from the engine block to the head. The particular number of thickened regions 32 and passages 34 is to be optimized in order to provide adequate cooling of the outer end portion of the liner 4 so as to provide effective cooling and thus prevent any overall loss of cooling effect from allowing the liner to contact the block over a section of the water jacket.

Figure 2:
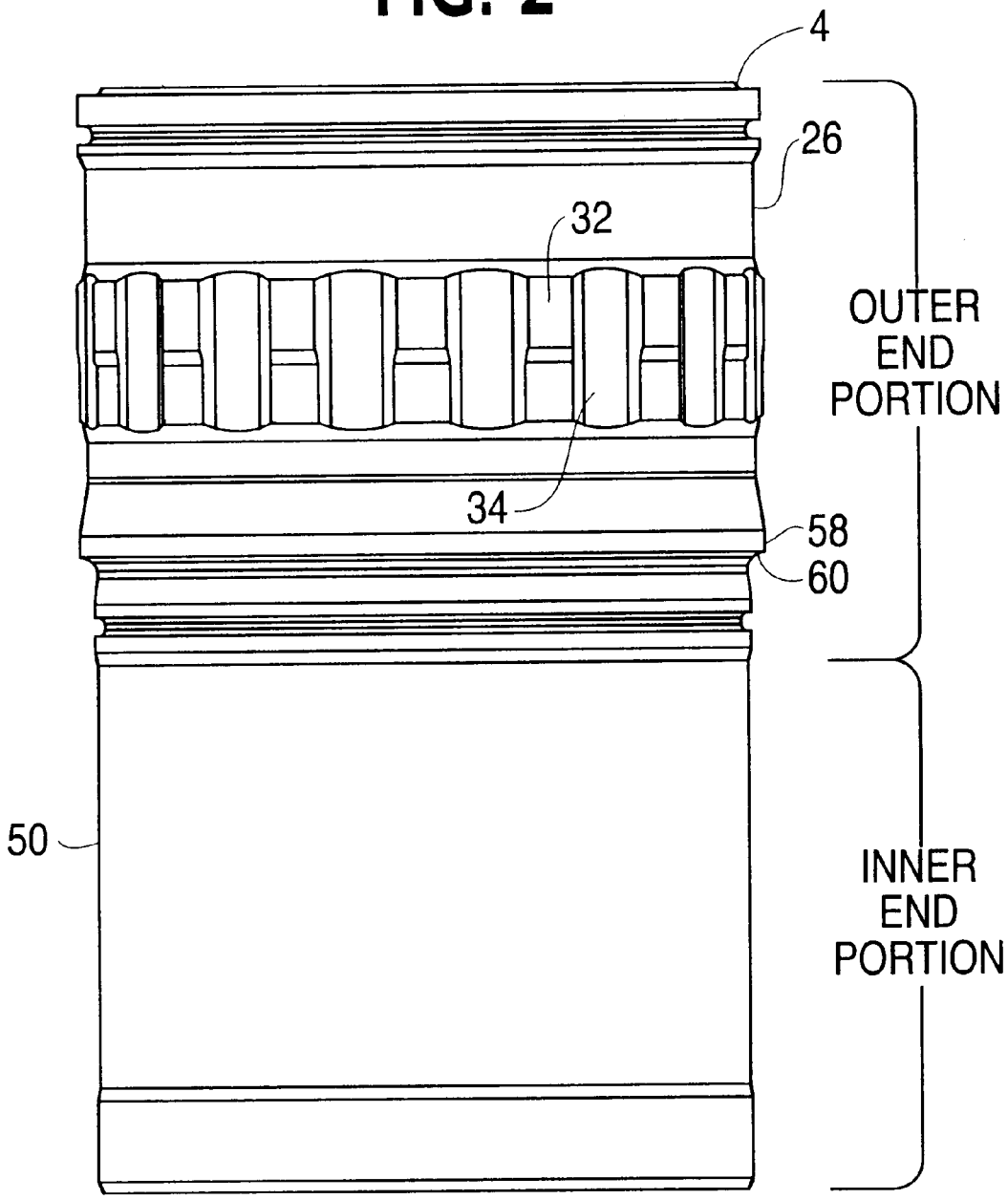
FIG. 2 is a side view of the cylinder liner formed in accordance with the present invention.
Figure 3:
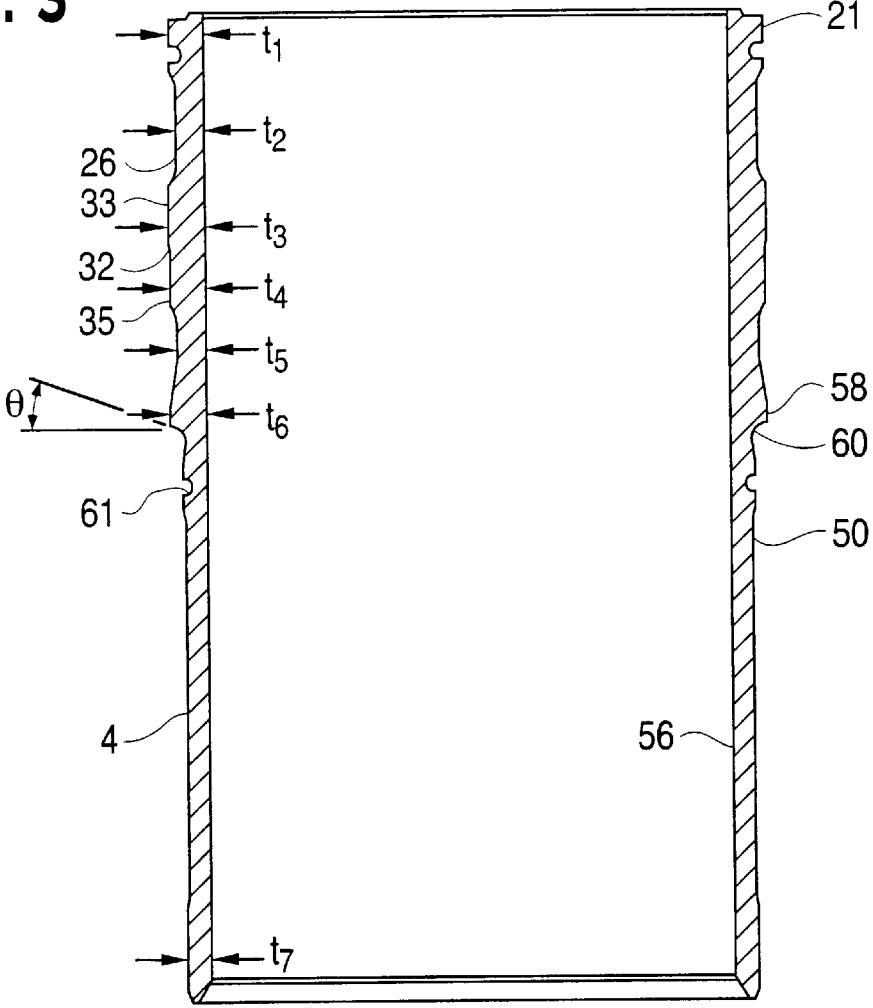
FIG. 3 is a cross-sectional view of the cylinder liner formed in accordance with the present invention.

With reference now to FIGS. 2 and 3, the particular configuration of the cylinder liner will be explained in greater detail hereinbelow.

Figure 4:
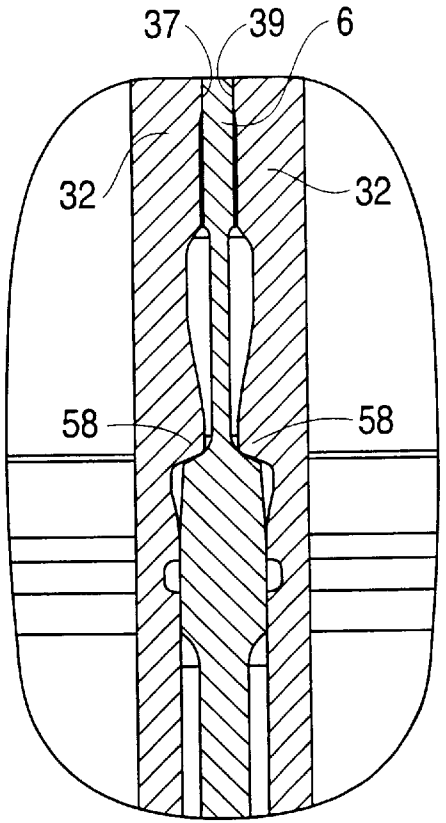
FIG. 4 is an expanded cross-sectional view of adjacent cylinder liners positioned within the cylinder block in accordance with the present invention.

Again, as referred to hereinabove, the cylinder liner 4 includes an outer end portion and an inner end portion which is readily received within the cylinder bore of an internal combustion engine. As noted hereinabove, it has been discovered that the liner design of FIG. 1 which is better illustrated in FIGS. 2, 3 and 4 provides an optimization of various design considerations. In particular, the liner illustrated in FIGS. 2 and 3 includes a hollow cylindrical body 50 having an inner end portion and an outer end portion as illustrated therein. The cylindrical piston engaging inside surface 56 of the hollow cylindrical body 50 extends the entire axial length of the hollow cylindrical body 50 as best illustrated in FIG. 3. Near the inner section of the outer end portion is a stop boss 58 formed on the outer surface of the outer end position 54 and includes a stop engaging surface 60 as illustrated in FIG. 3, this stop engaging surface extends at an angle θ with respect to a surface which is transverse to the central axis of the liner 4. This angle is preferably at least 5° and more preferably within the range of 10° to 30°. The stop engaging surface 60 is provided so as to engage liner stop 18 formed in the cylinder cavity 6 of the engine block as illustrated in FIG. 1. As will be described in greater detail hereinbelow, the configuration of this stop boss and the adjacent portions of the liner's outer surface have been found to be extremely important to the satisfactory operation of the subject liner. Particularly, the inclination of the stop engaging surface 60 has been provided so as to prevent outward sliding of the liner and maintain straightness of the liner within the cylinder cavity 6 of the engine block. Additionally, this mid stop type arrangement minimizes excessive bore distortion and high liner fillet stresses which can occur with a thin liner as will be discussed in greater detail hereinbelow.

Adjacent the stop engaging surface 60 is a cylindrical recess 61 formed about an outer surface of the liner inwardly of the stop engaging surface 60. This region may be utilized to accommodate an o-ring type sealing member to ensure sealing engagement with the cylinder cavity so as to prevent leakage of coolant from the water jacket as well as the leakage of crankcase gases or oil into the water jacket.

At an outermost end of the outer end portion of the liner is the end boss 21 which is formed on an outer surface for providing a reinforcing and securing means primarily for frictionally engaging the inside surface 22 of the cylinder cavity 6 to form a coolant seal and for resisting the deforming forces resulting from fuel combustion within the hollow cylindrical body. Particularly, the end boss prevents radial movement of the outer end portion of the cylinder liner while permitting limited axial movement of the outer end portion within the liner receiving cavity by forming a radial press fit with the inside surface of the liner receiving cavity 6 by compressively and frictionally engaging the inside surface of such cavity when pressed therein. As noted hereinabove, the outside cylindrical surface of the end boss has a diameter slightly greater than the inside diameter of the liner receiving cavity adjacent the end boss to form a coolant impervious press fit completely around the end boss 21 between the inside surface of the liner receiving cavity and the liner when the liner is placed within the cylinder cavity 6.

In addition to the press fit about the outer end portion which is created by the end boss 21, a second press fit area is achieved by the lands 32 which extend from the recess 26 of the liner 4. The thickness $t_3$ of the thickened portions 32 is of a thickness slightly less than that of the thickness $t_1$ of the end boss so as to permit the liner to be readily inserted within the cylinder cavity, however, an outermost diameter of the lands 32 is of a diameter which is slightly greater than an inside diameter of the cylindrical cavity at portions adjacent the lands 32 when the liner is positioned within the cylinder cavity so as to form a press fit therebetween. It is further noted in FIG. 3 that the lands 32 include a first portion or press fit region 34 as well as a region of reduced thickness 35 which aides in the placement of the liner within the cylinder cavity 6. Particularly, the thickened region 34 is of a thickness $t_3$ while the region 36 is of a thickness $t_4$.

Generally, the stop boss 58 is of a thickness $t_6$ which is less than the thickness $t_3$ of the lands 32 as well as the thickness $t_1$ of the end boss 21.

As can be seen from FIGS. 2 and 3, the recess 26 which extends from just above the stop boss 58 to the end boss 21 is of a the thickness $t_2$, $t_5$. This thickness is less than the thickness of conventional mid-stop liners. With the addition of the lands 32 having grooves 34 there between, the thickness of the annular recess 26 formed in the outer surface of the cylinder liner can be reduced. In doing so, the grooves conduct coolant fluid between the lower water gallery 24*a* adjacent the lower most portion of the recess 26 to an upper water gallery 24*b* adjacent the upper most portion of the recess 26. The thickness of the liner at the lower region of the annular recess 26 and upper region of the annular recess 26 are capable of being thin because the lands 32 support the liner and prevent excessive liner deflection and cavation which will otherwise occur if the entire annular recess 26 is of a reduced thickness. Additionally, the thickened portions 32 and grooves 34 are dimensioned so as to provide effective coolant passages which prevents any overall loss of cooling effect from allowing the liner to contact the block over a portion of the water jacket. Additionally, the cylinder liner 4 may include a thickened region $t_7$ at an innermost end of the inner end portion to provide additional stabilizing effect to the liner.

For purposes of illustration, one example of dimensions of a liner of the form discussed hereinabove is set forth in the following table wherein the relative sizes of the various liner sections illustrated in FIG. 3 can be ascertained, with all the dimensions in millimeters.

TABLE

| | DIMENSION | |
|---|---|---|
| THICKNESS | MAX | MIN |
| $t_1$ | 8.5005 | 8.4375 |
| $t_2$ | 8.425 | 6.155 |
| $t_3$ | 8.485 | 8.452 |
| $t_4$ | 8.125 | 7.855 |
| $t_5$ | 6.425 | 6.155 |
| $t_6$ | 8.450 | 8.370 |
| $t_7$ | 5.150 | 4.880 |

With reference now to FIG. 4, as can be seen therein the lands 32 of adjacent liners form an interference fit in the region 37 and 39 with the cylinder block 6. Additionally, the inclination of the stop boss 58 which is preferably at least 5° and more preferably within the range of 10° to 30° cooperates with the inclined surface of the block as to minimize excessive bore distortion and high liner fillet stresses which can occur with the thinned mid stop liner. Particularly, the inclination has the advantages of preventing outward sliding of the liner and maintaining straightness of the liner within the cylinder cavity. This is particularly important when the stop boss 58 of the liner form is of a higher temperature than that of the block 6.

From the foregoing, it is apparent that a cylinder liner as disclosed and described hereinabove combines, in a single simplistic design, several functional advantages which heretofore were not achieved by prior liners. Particularly, by providing a cylinder liner having a ring of vertical grooves and lands within a mid-section of the water jacket area establishing an interference fit between the liner and the block in this region allows for the remaining portion of the annual recess to be thinned thus increasing the cooling effect of the liner in this region. While the lands provide an interference fit between the liner and block in this region, the grooves or passages conduct coolant between the lower water gallery at an entry to the block to a similar upper water gallery at the exit from the block to the head. Again, this allows for the thickness of the liner at the lower and upper portions of the annular recess to be reduced compare to that of normal wet liner designs. With the incorporation of the lands which form an interference fit with the engine block in the mid section of the annular recess prevents excessive liner deflection and cavation which will occur if the entire annual recess were of a reduced thickness. This further occurs without sacrificing any overall loss of cooling effect from allowing the liner to contact the block over a section of the water jacket. In addition, the above described mid stop type liner includes a mechanism for minimizing excess bore distortion and high liner fillet stresses which can occur with a thin liner by inclining the stop engaging surface of the liner at least 5° and preferably 10° to 30° thus preventing outward sliding of the liner and maintaining straightness thereof.

While the present invention has been described with reference to a preferred embodiment, it will be appreciated by the skill and the art that the invention may be practice otherwise man has specifically described herein without departing the spirit and scope of the invention. It is, therefore, to be understood that the spirit and scope of the invention be limited only by the appended claims.

I claim:

1. A liner for a cylinder cavity within a cylinder block of an internal combustion engine having a liner stop positioned within the cylinder cavity at a point intermediate the extremes of travel of a piston disposed for reciprocating travel within the cylinder cavity comprising:

a hollow cylindrical body having an inner end portion and an outer end portion;

said outer end portion having a piston engaging inside surface for guiding the piston during travel and a top end face for forming a combustion gas seal with an engine head;

securing means for preventing radial movement of said outer end portion while permitting axial movement of said outer end portion relative to the liner stop;

a liner supporting means for axially retaining an innermost end of said outer end portion against axial movement relative to the cylinder cavity; said liner supporting means including a stop boss having a liner stop engaging surface for continuously engaging the liner stop when said liner is place within the cylinder cavity;

an annular recess formed in an outside surface of said outer portion extending over substantially an entire axial length of said outer end portion to form a liner coolant passage when said liner is positioned in said cylinder cavity; and a plurality of thickened regions circumferentially spaced about said outside surface of said outer end portion and within said annular recess, each of said thickened regions frictionally engaging an inside surface of the cylinder cavity thereby forming an interference fit between said liner and the cylinder cavity in a region between said securing means and said liner supporting means.

2. The liner as defined in claim 1, wherein said securing means includes an end boss adjacent an outer end of said outer end portion, an outer surface of said end boss having an outside diameter slightly greater than an inside diameter of corresponding portions of the cylinder cavity into which said end boss is press fitted.

3. The liner as defined in claim 2, wherein said circumferentially spaced thickened regions have an effective outside diameter less than said outside diameter of said end boss.

4. The liner as defined in claim 1, wherein said inner end portion is substantially out of contact with said cylinder block.

5. The liner as defined in claim 1, wherein said liner supporting means further comprises a straightening means for maintaining a straightness of said hollow cylindrical body with respect to said cylinder cavity.

6. The liner as defined in claim 1, wherein said straightening means includes an inclined liner stop engaging surface with said liner stop engaging surface inclining from said outer end portion towards said inner end portion.

7. The liner as defined in claim 6, where an angle of inclination of said liner stop engaging surface is at least 5 degrees.

8. The liner as defined in claim 6, wherein an angle of inclination of said liner stop engaging surface is in a range of 5° to 30°.

9. The liner as defined in claim 1, wherein said plurality thickened regions divide said annular recess into an outer annular recess and an inner annular recess with flow passages provided between adjacent thickened regions so as to transfer a cooling medium between said inner annular recess and said outer annular recess.

10. The liner as defined in claim 9, wherein each of said thickened regions includes a substantially planar surface.

11. The liner as defined in claim 10, wherein said substantially planar surface includes stepped regions.

12. A liner for a cylinder cavity within a cylinder block of an internal combustion engine having a liner stop positioned within the cylinder cavity at a point intermediate the extremes of travel of a piston disposed for reciprocating travel within the cylinder cavity compromising:

a hollow cylindrical body having an inner end portion and an outer end portion;

reinforcing and securing means for resisting deforming forces resulting from fuel combustion within said outer end portion and for compressively and frictionally engaging an inside surface of the cylinder cavity when pressed there into, said reinforcing and securing means including;

an end boss adjacent an outer end of said outer end portion, an outer diameter of an outer surface of said end boss being slightly greater than an inside diameter of corresponding portions of the cylinder cavity into which said end boss is press fitted, a liner supporting means for axially supporting said hollow cylindrical body within the cylinder cavity, said liner supporting means including a liner stop engaging surface for engaging the liner stop when said liner is placed within the cylinder cavity; and a plurality of thickened regions circumferentially spaced about an outside surface of said outer end portion intermediate said end boss and said liner supporting means, said circumferentially spaced thickened regions having an effective outside diameter less than said outside diameter of said end boss and slightly greater than an inside diameter of corresponding portions of the cylinder cavity into which said plurality of thickened regions are press fitted.

13. The liner as defined in claim 12, wherein said outside diameter of said end boss is greater than a diameter of any other portion of said hollow cylindrical body.

14. The liner as defined in claim 12, wherein said inner end portion is substantially out of contact with said cylinder block.

15. The liner as defined in claim 12, wherein said liner supporting means further comprising a straightening means for maintaining a straightness of said hollow cylindrical body with respect to said cylinder cavity.

16. The liner as defined in claim 15, wherein said straightening means, includes an inclined liner stop engaging surface with said liner stop engaging surface inclining from said outer end portion towards said inner end portion.

17. The liner as defined in claim 16, where an angle of inclination of said liner stop engaging surface is at least 5°.

18. The liner as defined in claim 16, wherein an angle of inclination of said liner stop engaging surface is in a range at 5° to 30°.

19. The liner as defined in claim 12, further comprising an annular recess formed in an outside surface of said outer portion extending between said end boss and said liner supporting means.

20. The liner as defined in claim 19, wherein said plurality of thickened regions extend from said annular recess.

21. The liner as defined in claim 20, wherein said plurality of thickened regions divide said annular recess into an outer annular recess and an inner annular recess with flow passages provided between adjacent thickened regions so as to transfer a cooling medium between said inner annular recess and said outer annular recess.

22. The liner as defined in claim 21, wherein each of said thickened regions includes a substantially planar surface.

23. The liner as defined in claim 22, wherein said substantially planar surface includes stepped regions.

* * * * *